US006357121B1

(12) United States Patent
Mattinger

(10) Patent No.: US 6,357,121 B1
(45) **Date of Patent: *Mar. 19, 2002**

(54) SCISSORS FOR CUTTING FILAMENTARY MATERIAL, ESPECIALLY HAIR, UNIFORMLY WITHOUT PINCHING OR TEARING

(75) Inventor: Detlef Mattinger, Bickenbach (DE)

(73) Assignee: Wella Aktiengesellschaft, Darmstadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,979

(22) PCT Filed: Jul. 22, 1998

(86) PCT No.: PCT/EP98/04609

§ 371 Date: Feb. 26, 1999

§ 102(e) Date: Feb. 26, 1999

(87) PCT Pub. No.: WO99/07528

PCT Pub. Date: Feb. 18, 1999

(30) Foreign Application Priority Data

Aug. 9, 1997 (DE) ..... 197 34 605

(51) Int. Cl.[7] ..... B26B 13/00
(52) U.S. Cl. ..... 30/216; 30/228; 30/239
(58) Field of Search ..... 30/131, 208, 228, 30/239, 241, 215, 216

(56) References Cited

U.S. PATENT DOCUMENTS

| | | | | | |
|---|---|---|---|---|---|
| 1,129,684 | A | * | 2/1915 | Jones | 30/228 |
| 1,802,571 | A | * | 4/1931 | Orussa | 30/228 |
| 1,806,555 | A | * | 5/1931 | Gonsett | 30/228 |
| 2,273,536 | A | * | 2/1942 | Pollak | 30/228 |
| 3,262,201 | A | * | 7/1966 | Docken | 30/228 |
| 3,421,218 | A | * | 1/1969 | Thompson | 30/228 |
| 3,474,534 | A | * | 10/1969 | Murphy | 30/228 |
| 3,602,988 | A | * | 9/1971 | Little | 30/228 |
| 3,666,975 | A | * | 5/1972 | Balamuth | 30/228 |
| 3,934,526 | A | * | 1/1976 | Damast et al. | 30/228 |
| 5,800,448 | A | * | 9/1998 | Banko | |
| 5,935,142 | A | * | 8/1999 | Hood | |

FOREIGN PATENT DOCUMENTS

| | | | |
|---|---|---|---|
| JP | 02031788 | * | 1/1990 |
| JP | 7-9389 | * | 1/1995 |
| JP | 2001-37769 | * | 2/2001 |

* cited by examiner

*Primary Examiner*—Kenneth E. Peterson
(74) *Attorney, Agent, or Firm*—Michael J. Striker

(57) ABSTRACT

The scissors for cutting filamentary material, especially hair, include two shanks (4) pivotally connected to each other at a pivot joint (2); respective blades (7) for cutting the filamentary material extending from the shanks (4) and an electrically powered vibrator (5) for vibrating one of the shanks in a longitudinal direction at an ultrasonic frequency and with a displacement of about 100 to 200 $\mu$m. The pivot joint (2) includes a nail (14) extending from one shank, an eccentric washer (15) embedded in the other shank which engages around the nail and a miniature motor (17) for rotating the washer (15) and the shank in which it is embedded. In other embodiments the electrically powered vibrator (5) include a piezoelectric transducer (8) arranged to connect a shank to one of the blades or an exciter coil (19) wrapped around a strut region made of a magnetostrictive material in one shank.

1 Claim, 3 Drawing Sheets

SCISSORS FOR CUTTING FILAMENTARY MATERIAL, ESPECIALLY HAIR, UNIFORMLY WITHOUT PINCHING OR TEARING

BACKGROUND OF THE INVENTION

1. Field of the Invention

The invention relates to a pair of scissors with two shanks joined to one another via a pivot joint, in particular hairdressing shears.

2. Prior Art

Known scissors operate with cutting edges that move about a common, fixed pivot point relative to one another. In the process, the cutting edges slide on one another so that they touch at point (the cutting point).

When the scissors close, the cutting point moves out from the common pivot point of the scissors in the direction toward the tip of the scissors.

In this process, the opening angle of the scissors, that is, the angle of the cutting edges converging on one another, also changes.

Filament-like material to be cut, such as hair, depending on the opening angle, edge sharpness, and so forth, slides more or less far in front of the actual cutting point until it begins to be cut, is held, and then severed. Since in this cutting method, the material to be cut does not execute a defined rolling motion about its longitudinal axis, necessarily only a partial cross section of the material to be cut is actually cut, while the rest is virtually pinched off or torn off.

Poorly cut hair is finally the starting point for subsequent damage and can cause splitting, among other effects.

SUMMARY OF THE INVENTION

The object of the invention is to cut filamentary material to be cut, especially hair, uniformly over its circumference and cross section without any zones of pinching and tearing.

According to the invention this object is attained by a scissors comprising two shanks pivotally connected to each other at a pivot joint; respective longitudinally extending blades for cutting the filamentary material attached to a corresponding shanks and means for vibrating at least one blade in the longitudinal direction, which comprises an electrically powered vibrator. Accordingly, at least one shank can be made to vibrate parallel to the longitudinal direction of this shank by means of the electrically powered vibrator.

The invention has the advantage that filamentary material to be cut, in particular hair, can be cut uniformly over its circumference and cross section without pinching and tearing zones. With the scissors of the invention, the hair slides between the cutting edges while it is being cut through. In the process it is reliably and uniformly severed. When the scissors are closed, the axially oscillating motion component that is additionally superimposed on at least one cutting edge leads to improved cutting properties.

Further advantageous features of the invention are described hereinbelow.

Good cutting results are attained if the vibrator includes a piezoelectric travel transducer, which is located between the blade and an end of the shank toward the handle, and connects the blade and the end of the shank. The oscillating motion is determined by the frequency and amplitude at which the piezoelectric travel transducer vibrates.

The oscillating motion should be executed at such a high frequency that during normal use of scissors, the hair rolls over its circumference on the cutting edges at least once during the cutting operation.

The amplitude of the vibration depends on the circumference of the hair. The initial amplitude value can be approximately 100 to 200 $\mu$m.

If both cutting edges vibrate simultaneously with phase-offset from one another, then half the amplitude suffices.

A system with adjustable amplitude and frequency for different material to be cut is thus possible.

The piezoelectric travel transducer can be operated at an ultrasonic frequency. It is integrated into at least one cutting edge. In a manner analogous to an ultrasonic cleaning sonotrode or a welding sonotrode, the longitudinal wave is transmitted along the cutting edge. The vibration generator, which in the final analysis is mechanical, may be disposed on the side of the cutting edge or strut of the scissors. If on the side of the strut, corresponding mechanical play at the bearing point would have to be considered. This applies equally to other vibrators on the strut.

The system is triggered electrically by an ultrasonic generator, which is coupled via electrical connecting cords to the electromechanical vibrator.

Good cutting results are also attained if, as the vibrator, an eccentric washer that surrounds the nail of the joint is provided; if the eccentric washer is inserted into a round recess in the shank and is rotatably joined to the nail; and if a miniature motor is provided for rotating the eccentric washer about the nail. To that end, a standard connecting nail is replaced with an electromechanically driven eccentric unit. The axial component of the eccentric motion leads to the desired cutting motion. As the drive for the eccentric unit, a miniature motor is sufficient and has the advantage of not making the scissors harder to manipulate.

The vibrator can also be embodied such that the shank at least in some regions comprises a magnetostrictive material, and a rigid, stationary exciter coil is wrapped around this material. The cutting edges of the scissors are mounted here on a base body of magnetostrictive material. By applying an electromagnetic field to the magnetostrictive material, a change in length of the material and finally an oscillation of the cutting edges relative to one another are brought about. The exciter coils may be disposed in the strut region of the scissors. The exciter coil is connected to a generator via an electric connecting cord.

Nickel or a nickel alloy is suitable as the material. First, nickel has the required magnetostrictive properties, and second, nickel steel is very highly suitable for manufacturing scissors. To prevent contact allergies, the material may have a plastic coating.

BRIEF DESCRIPTION OF THE DRAWING

The invention will be described in further detail below in conjunction with drawings that show exemplary embodiments, in which.

DESCRIPTION OF THE PREFERRED EMBODIMENTS

Figure 1:
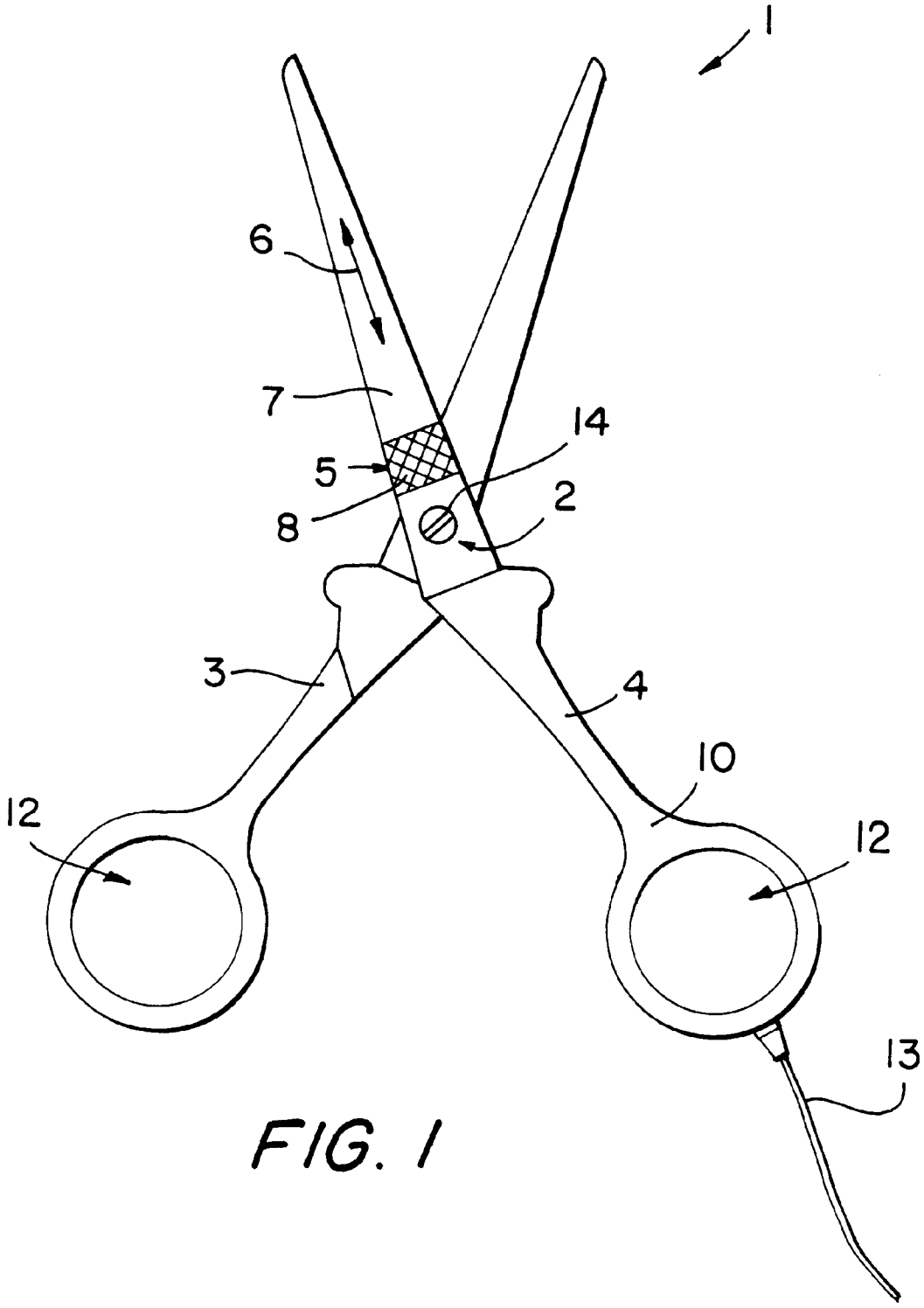
FIG. 1, is a side view of a pair of scissors whose shanks are pivotably connected to one another via a nail, and whose ends of the shanks toward the handles each have an eye; as the vibrator, a piezoelectric travel transducer is provided between one blade and the end of the shank.

In a pair of scissors 1 with two shanks 3, 4 joined together via a pivot joint 2, one shank 4 can be set into vibration (FIG. 1) parallel to the longitudinal direction 6 of the blade 7 of this shank 4 by means of an electrically powered vibrator 5. The vibrator 5 includes a piezoelectric travel transducer 8, which is located between the blade 7 and the pivot joint 2. The piezoelectric travel transducer 8 is a connection, which joins the blade 7 and the end 10 of the shank 4 toward the handle to one another. The pair of scissors 1 is embodied as hairdressing shears, with eyes 12. An electric cord 13 supplies an ultrasonic frequency to the piezoelectric travel transducer 8. During a cutting operation, the vibration of the blade 7, whose amplitude is 150 $\mu$m, is utilized to cut hair better.

Figure 2:
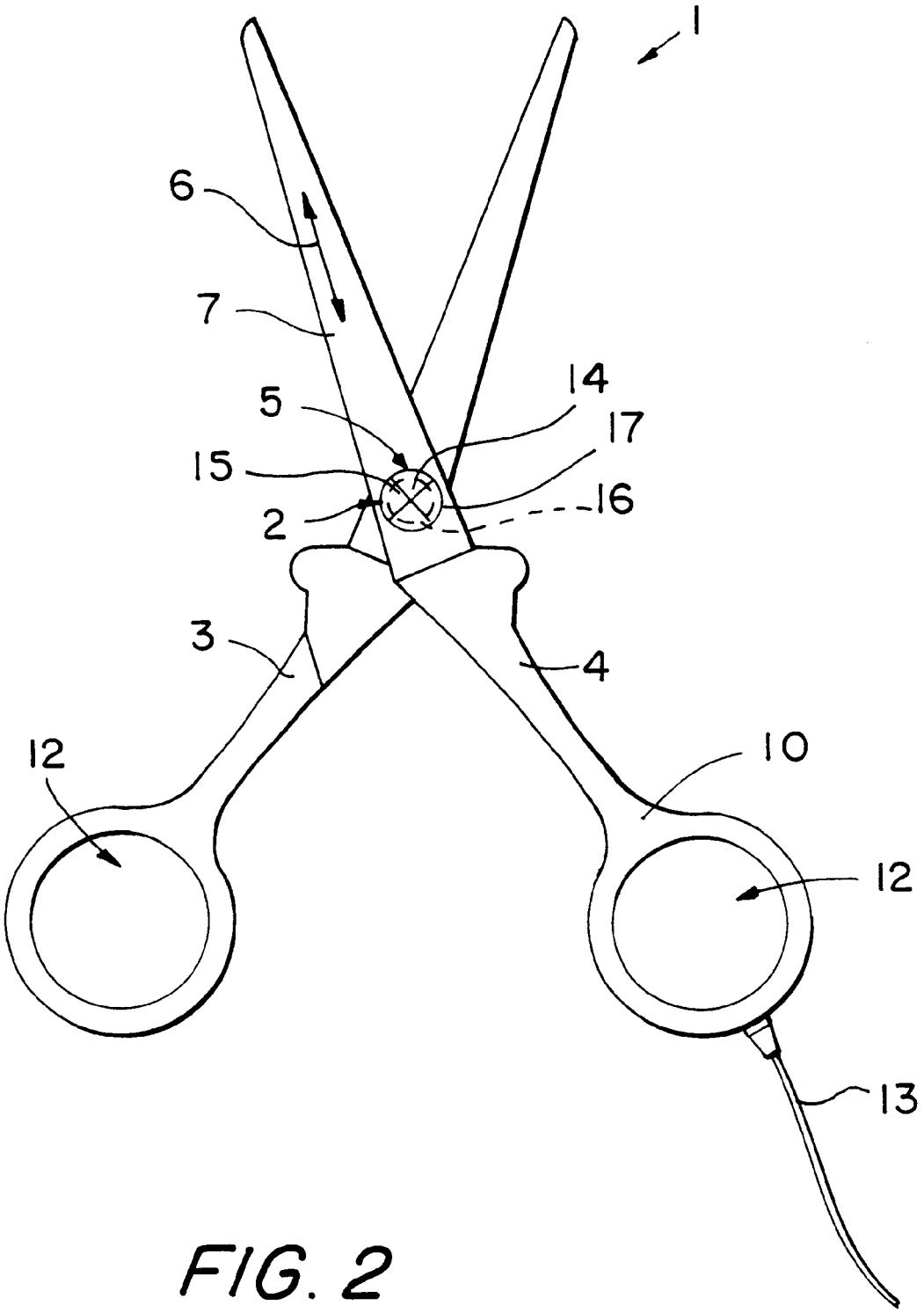
FIG. 2, is a side view of a pair of scissors analogous to FIG. 1, but with a vibrator which has an eccentric washer surrounding the nail and a miniature motor for turning the eccentric washer.

In the scissors 1 of FIG. 2, an eccentric washer 15 surrounding the nail 14 of the joint 2 is provided as the vibrator 5; it is inserted into a round recess 16 of the shank 4 and is rotatably connected to the nail 14. The eccentric washer 15 rotates about the nail 14. This rotary motion is attained by means of a miniature motor 17. The entire shank 4 executes the vibration.

Figure 3:
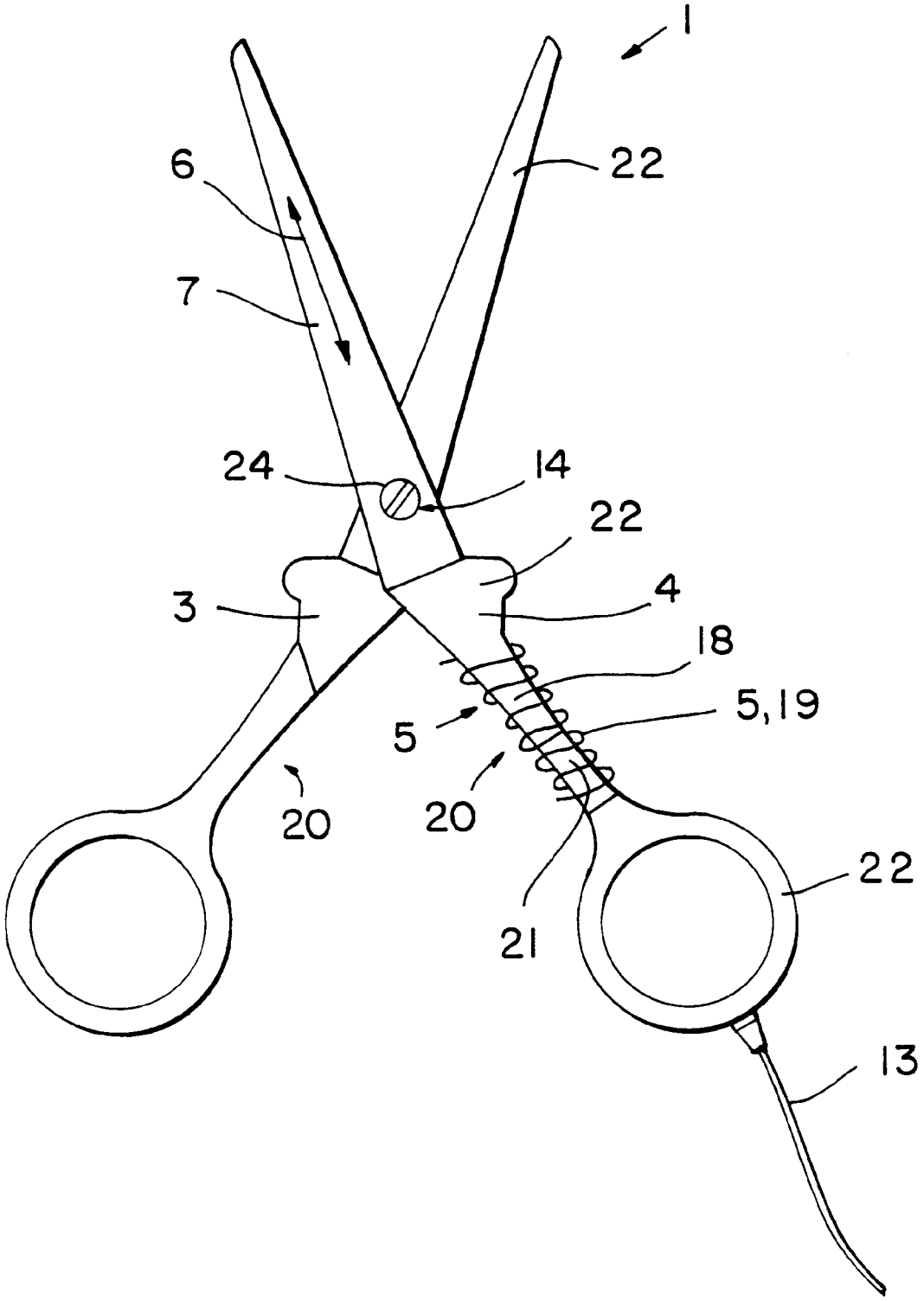
FIG. 3, is a side view of a pair of scissors analogous to FIG. 1, but with a vibrator which has a magnetostrictive material on a strut and a rigid, stationary exciter coil surrounding the material.

In the exemplary embodiment of FIG. 3, a magnetostrictive material 18, around which a rigid, stationary exciter coil 19 is wrapped, is provided as the vibrator 5. The vibrator 5 is provided on the strut 20 of the shank 4. Only inside the exciter coil 19, within one strut region 21, has a magnetostrictive material 18 been used. Otherwise, the pair of scissors 1 has been made of conventional scissors steel. The material 18 is a nickel alloy.

At the nail 14, the shank 4 has a play 24 in the longitudinal direction 6 of the shank 4. The play 24 has a length of 150 $\mu$m in the longitudinal direction 6, corresponding to the amplitude of the vibration of the blade 7.

In the preferred embodiments shown in FIGS. 1 to 3 each blade 7 istriangular and has a tip on a free end thereof opposite from the shank 4 connected with it. The longitudinal direction 6 in which the blade vibrates is a direction along a line passing through the tip of the blade that bisects the blade and thus differs from the direction along the cutting edge of the blade.

What is claimed is:

1. A scissors for cutting hair without pinching or tearing, said scissors comprising respective shanks (4) connected with corresponding blades (7) extending in a longitudinal direction (6) from said respective shanks, said respective shanks having corresponding eyes (12) at opposite ends thereof from said blades (7); and means (2) for pivotally connecting said respective shanks (4) with each other so that one of said shanks together with one of said blades connected with said one of said shanks vibrates in said longitudinal direction with ultrasonic vibrations having an amplitude of from 100 to 200 $\mu$m;

wherein said means (2) for pivotally connecting said respective shanks comprises a nail (14) extending from another of said shanks and an eccentric washer (15) arranged in said one of said shanks for engagement with said nail, said nail (14) extending through said eccentric washer (15) and a miniature motor (17) for rotating the eccentric washer (15) about the nail (14), so as to produce an eccentric motion of said washer (15) around said nail (14), an axial component of said eccentric motion producing a vibration of said one of said blades (7) in said longitudinal direction.

* * * * *